United States Patent [19]

Wilkinson

[11] Patent Number: 5,029,449

[45] Date of Patent: Jul. 9, 1991

[54] HEAT PUMP BOOSTER COMPRESSOR ARRANGEMENT

[75] Inventor: William H. Wilkinson, Columbus, Ohio

[73] Assignee: Gas Research Institute, Chicago, Ill.

[21] Appl. No.: 483,636

[22] Filed: Feb. 23, 1990

[51] Int. Cl.[5] ..... F25B 1/10; F25B 27/00

[52] U.S. Cl. ..... 62/175; 62/196.2; 62/323.4; 62/510; 62/160; 165/29

[58] Field of Search ..... 62/510, 175, 196.1, 62/196.2, 196.3, 228.1, 228.4, 228.5, 323.1, 323.4, 160; 236/1 EA; 415/60, 61, 122.1, 123, 124.1, 124.2; 165/29

[56] References Cited

U.S. PATENT DOCUMENTS

| | | | |
|---|---|---|---|
| 2,889,691 | 6/1959 | Schjolin | 62/323.4 X |
| 3,151,469 | 10/1964 | Quick | 62/325 |
| 4,055,965 | 11/1977 | Girard | 62/510 |
| 4,105,372 | 8/1978 | Mishina et al. | 415/122.1 X |
| 4,250,721 | 2/1981 | Wilmers et al. | 62/510 |
| 4,347,714 | 9/1982 | Kinsell | 62/510 |
| 4,454,725 | 6/1984 | Cann | 62/324.1 |
| 4,528,823 | 7/1985 | Mochizuki et al. | 62/510 |
| 4,614,090 | 9/1986 | Kaneko et al. | 62/175 X |

*Primary Examiner*—Harry B. Tanner

*Attorney, Agent, or Firm*—Watkins, Dunbar & Pollick

[57] ABSTRACT

A refrigeration and heat pump system of the refrigerant gas compression type having selectively operable first and second heat exchangers, respectively, in heat exchange relationship with a heat sink or source and a heating or cooling load, and with a an internal combustion engine driving a plurality of refrigerant gas compressors with more than one of the compressors selectively engagable when the system is operated in the heat pumping mode and the heat source is at low ambient temperature. The system includes at least one speed increaser connected between the plurality or compressors, so that the compressors operate at difference speeds although driven by the same engine.

2 Claims, 2 Drawing Sheets

HEAT PUMP BOOSTER COMPRESSOR ARRANGEMENT

TECHNICAL FIELD OF THE INVENTION

This invention relates to engine driven heat pump systems. More particularly it relates to those systems which are driven by internal combustion engines wherein the engine drives a refrigerant compressor for the full range of ambient outdoor temperatures experienced in residential heating and cooling heat pump systems.

BACKGROUND OF THE INVENTION

This invention is directed primarily to heat pump systems which are applied to heating and air conditioning loads of the environment in the living spaces of buildings. As used herein, the term air conditioning means the adjustment of the temperature and humidity in the living space to selected comfortable norms when the outside environment and particularly the ambient temperature is either too high or too low for comfort. However many of the objectives in concepts of this invention also have application to other types of thermal loads. Therefore the term "load" as used herein while specifically in the context of air conditioning, may be interpreted broadly to apply to other thermal loads by those familiar with heating and cooling technology.

It is well recognized that air conditioning and heat pumping thermal systems require a heat source from which the heat load may be transferred in the heating mode. In recent time, and in and particularly in connection with air conditioning activity, efforts have been directed to the convenient economical use of ambient outside air as the heat sink for the cooling load and also as the heat source in the heating or heat pumping mode. An additional problem with the operation of heat pumping systems of the air source type is that when the outside temperature is very low it is difficult to efficiently operate the refrigerant gas compressor as the refrigerant gas is very thin at low temperature and therefore the load on the compressor is drastically reduced in many cases to the point where auxiliary heat is required. However, with an engine driven heat pump system the engine can be speeded up by increasing the throttle setting to a point where effective heating can take place although the compressor is operating relatively inefficiently for the shortened period of time.

With engine driven heat pump operation this "limited breathing" (swallowing capacity) of a positive displacement compressor at cold outdoor ambient temperatures is accentuated. Not only is the mass flow of refrigerant so low that insufficient condensation energy is delivered to the living space, but also the load on the engine is so low that there is only a small amount of waste heat to be recovered. This would not be true if sufficient refrigerant flow could be induced. Sufficient refrigerant flow can be induced by increasing the compressor speed relative to the engine. Nevertheless, in some circumstances the engine speed required would be too great to overcome the loss in capacity so that the requirement for auxiliary heat would not be overcome. In the concept of this invention a unique alternative approach is presented in which a first "main" compressor is matched to the engine for cooling service and a second "boost" compressor is provided.

Others have sought the solutions to the problems previously stated above including inventors of various patents that are found in the prior art.

Such patents include U.S. Pat. No. 4,528,823 Mochizuki, et al. which discloses a heat pump apparatus having a plurality of compressors and heating condensers connected to the compressors. Vapor and liquid refrigerants are separated after leaving the condensers. The vapor is directed to the next stage. U.S. Pat. No. 4,454,725 Cann relates to the method and apparatus for integrating a supplemental heat source with staged compressors in a heat pump which is reversible. Supplemental heat is applied to the suction line of the high compressor.

U.S Pat. No. 4,347,714 Kinsell, et al. reveals heat pump systems to provide efficiency for residential use. An auxiliary turbine is connected to provide energy from natural gas. U.S. Pat. No. 4,250,721 Wilmers, et al. shows a compression heat pump in which the required compressor speed is reduced by injection pumping refrigerant into the compressor suction when higher compressor speed would otherwise be required.

U.S. Pat. No. 4,055,965 Girard discloses a heat pump having a precompressor super heater to enhance the compressor operations when the condenser cooling is in excess of requirements. U.S. Pat. No. 3,151,469 Quick relates to a heat reclaiming system for buildings that have a refrigeration load as well as an air conditioning load. Heat pump operation is augmented by selectively passing room air across the condensers of the heat pump or refrigeration system.

SUMMARY OF THE INVENTION DISCLOSURE

In summary, this invention is a refrigeration and heat pump system comprising: an internal combustion engine operatively connected to a first compressor means for compressing refrigerant gas for circulation in a refrigeration and heat pumping subsystem. The heat pumping subsystem comprises a first heat exchanger in heat exchange relation to an ambient sink or source of heat, a second heat exchanger in heat exchange relation to a heating or refrigeration load, and means for switching the circulating compressed gas from passage through the first and second heat exchangers before expansion in the other of the first or second heat exchangers followed by circulation to the first compressor means. Included is a second compressor means operatively connectable to a drive train from the engine, by means of a clutch engage or disengage the connection with the second compressor means. In addition there is provided valve means that is selectively operable to direct the recirculation of the refrigerant gas to the second compressor means when the connection means is selectively operated to engage connection to the engine. In further addition, a speed increasing means is provided in the drive train between the connection means and the second compressor means for increasing the output, pressure, and capacity of the second compressor when operating with the connection means engaged. And finally, there is included means for connecting the output of the second compressor into the input of the first compressor when the system is operating with the speed increasing means connected in the drive train thereby increasing the output, pressure, and capacity of the second compressor.

From the foregoing, and otherwise, advantages of the invention will become apparent from the following disclosure in which the preferred embodiment of the invention is described in detail and illustrated in the accompanying drawings. It is contemplated that variations and procedure, structural features and arrangement of parts may appear to those skilled in the art without departing from the scope or sacrificing any of the advantages of the invention.

Figure 1:
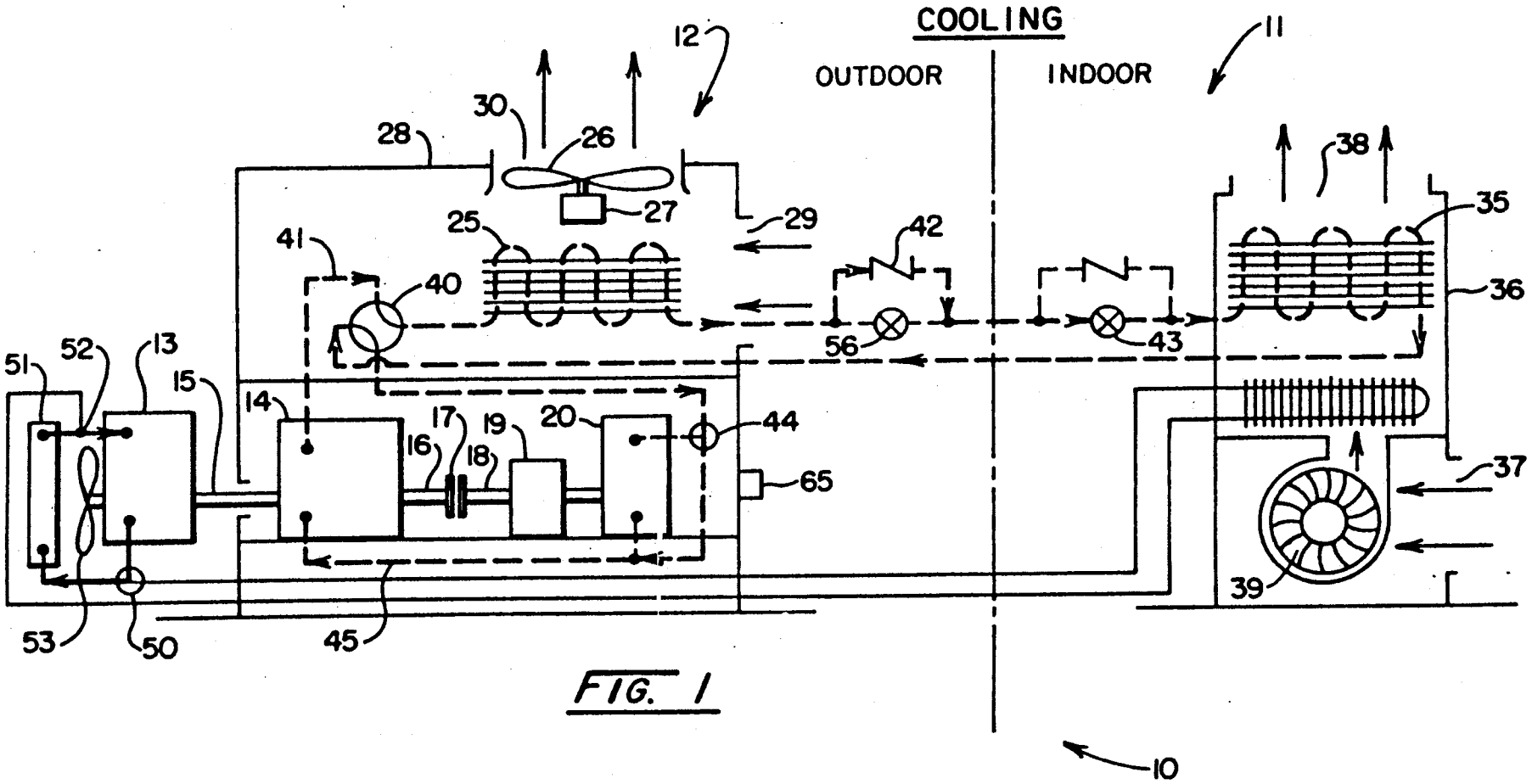
FIG. 1 is a schematic diagram of the system of this invention in which the method of the invention is practiced. The system shown has been selectively arranged for operation in the cooling mode.

In the following description of the preferred embodiment of the invention, which is illustrated in the drawings, specific terminology will be used for the sake of clarity. However, it is not intended that the invention be limited to the specific terms so selected or the system so shown, and it is to be understood that each specific term includes all technical equivalents which operate in a similar manner to accomplish a similar purpose.

DETAILED DESCRIPTION OF THE INVENTION AND BEST MODE OF PRACTICING A PREFERRED EMBODIMENT

The system is described in an application to living space heating and cooling requirements, commonly referred to as an air conditioning setting. Other types of heating and cooling loads might be substituted in appropriate situations.

Referring to FIG. 1 the system 10 comprises an indoor unit 11 and an outdoor unit 12.

The outdoor unit 12 includes an internal combustion engine 13 operatively connected in a drive train to a first compressor means 14 by a shaft 15. An output shaft 16 is provided with a connection means or clutch 17 of the drive train, which is engagable through a shaft 18 to a speed increaser 19. The speed increaser may be typically one of a variety of connection gear box or drive belt arrangements which increase the rotation of the driven shaft to the drive shaft. The output of the speed increaser 19 is connected in the drive train to a second compressor means 20.

The outdoor unit 12 includes a first heat exchanger 25 and a fan 26 driven by a motor 27. A housing 28 surrounds the outdoor unit 12 except for the engine 13. An inlet aperture 29 and an outlet aperture 30 provide for outside ambient air to be drawn through aperture 29 and across and in heat exchange relation to the first heat exchanger 25 before exhausting through the aperture 30.

The indoor unit 11 includes a second heat exchanger 35 placed in a housing 36 having an inlet aperture 37 and an outlet aperture 38. A blower 39 induces indoor air from the living space through the housing 36 before it is returned to the living space through aperture 38 after passing across and in heat exchange relation to the heat second heat exchanger 35.

Cooling Mode

Referring to FIG. 1, in the refrigeration subsystem operating in the cooling mode, the compressor 14 is connected to a selector valve 40 by a conduit 41. Valve 40 is selectively positioned to convey hot compressed refrigerant gas to the first heat exchanger 25 where it is condensed by the cooler outdoor air circulating through the housing 28. Condensed liquid refrigerant passes through a check valve 42 to an expansion valve 43. Cooled high pressure refrigerant liquid is expanded and vaporized into the second heat exchanger 35 where it evaporates and is heated by the heat exchange relation with the air circulating through the housing 36 from the indoor living space. Warm low pressure refrigerant gas is circulated back through the selector valve 40 and returns through a connection 44 and conduit 45 to the first compressor means 14. Operation in the cooling mode may be substantially conventional for a vapor compression refrigeration cooling system.

In the cooling mode heat from the internal combustion engine 13 is circulated by means of a working radiator fluid, such as ethylene glycol and water, through a selector valve 50 and through an outdoor radiator 51, from which it is returned to the engine through a connection 52. A fan 53 draws air across the radiator increasing the heat exchange relation.

As will be clear to those skilled in the art, the engine is cooled by means of passages for the working fluid "coolant", and the coolant is circulated through the engine by means of a pump that is driven by the engine. The coolant is used as the working fluid in the cooling mode to dissipate excess combustion heat from the engine.

High Ambient Heating Mode

Figure 2:
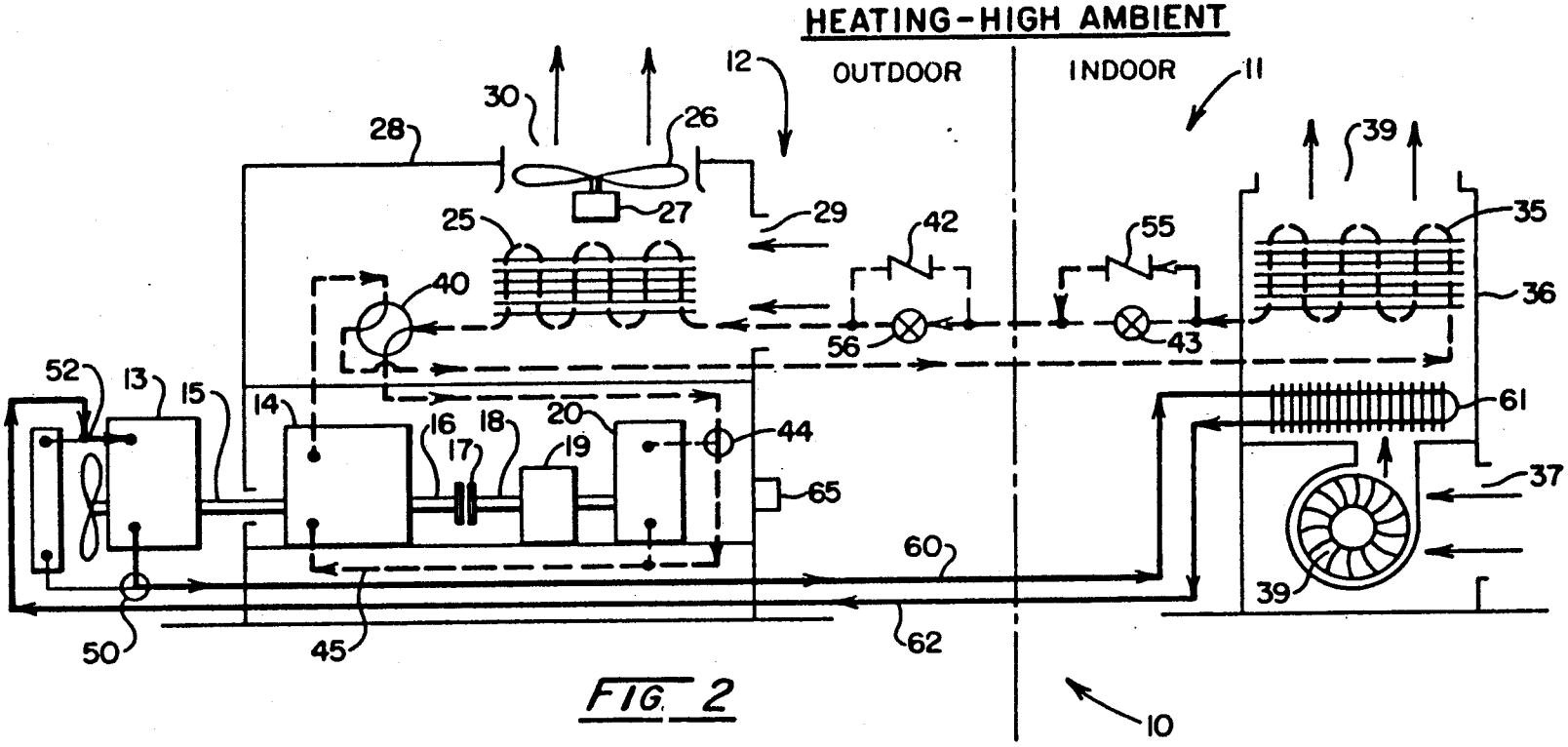
FIG. 2 is a schematic view of the system of this invention in the heating mode with the components selectively arranged for high ambient outdoor temperature conditions.

Referring to FIG. 2, when the outside air temperature is above about 35 degrees F. (1.5° C.) the system 10 is operated in the heating mode by reversing the position of the selector valve 40 so that hot compressed refrigerant gas from the first compressor means 14 is carried to the second heat exchanger 35 where it exchanges heat to the air passing through the indoor unit 11 under the influence of the fan 39. As the air passes across the heat exchanger 35 the refrigerant gas is cooled and condensed before passing through the check valve 55 to an expansion valve 56 where it is vaporized into the first heat exchanger 25. Heat of vaporization is extracted from the outdoor ambient air passing through the outdoor unit 12. Low pressure warmed refrigerant gas is circulated back through the connector valve 40 and is returned through a connection means 44 and conduit 45 to the first compressor means 14.

In this mode, the working fluid from the engine is redirected by selector valve 50 and passed through the conduit 60 to a third heat exchanger 61. By this means exhaust and excess combustion heat from the engine provides supplemental heat to the air passing through the indoor unit 11. The working fluid returns to the first compressor means 14 through conduit 62 by means of connection 52.

Low Ambient Heating Mode

Figure 3:
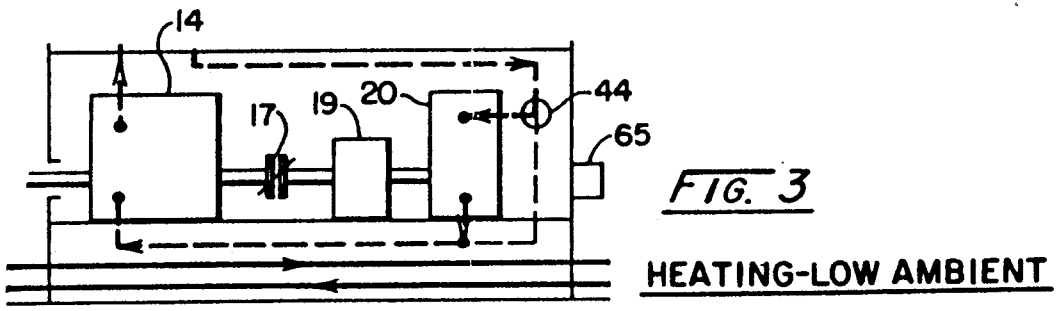
FIG. 3 is a schematic view of a portion of the system of this invention with the components selectively arranged for operation in the heating mode with low ambient outdoor temperature conditions.

Referring to FIGS. 2 and 3, when the outside air is below about 35 degrees F. (1.5° C.) the system continues to operate in the heating mode with decreasing heating capacity. In this heating mode circulating returning low pressure refrigerant gas is directed through the connection means 44 to the second compressor means 20 when the clutch 17 is engaged.

The connection means 44 may be a switching valve actuated by an electric or air control subsystem. The control subsystem includes a condition sensor means or thermometer element 65 positioned in operative contact with the ambient conditions to provide a signal to or to actuate the connection means 44 and the clutch 17, when they are selectively set to be operated.

The speed increaser 19 causes the second compressor means 20 to operate at sufficient capacity to provide an increase of gas volume to the first compressor means 14 at higher pressure. By this means the first compressor means provides higher pressure refrigerant gases into the refrigeration and heat pump subsystem. Since the first heat exchanger has a higher volume of gas to compress with a higher pressure, the engine 13 will be required to operate at higher speed and load, thereby producing more exhaust and excess combustion heat for circulation to the third indoor heat exchanger 61.

The overall concept of this invention is to provide the first compressor means with a capacity matched to the engine for operation in the cooling mode with the second compressor means declutched from the first compressor shaft and with the connection 44 feeding refrigerant directly to the inlet of the first compressor means.

Heating in the warm ambient mode is similarly operated, with increasing engine speed progressively as the cooler outside ambient temperatures impose more load on the living air conditioned space. Before the engine reaches maximum speed, the second compressor means is engaged through the clutch 17, and the connection 44 is set so that the intake to the first compressor means is forced to come from the discharge of the second compressor means.

This creates a two-stage compression where the pressure ratio of the second compressor means is close enough to constant that it is constructed as a simple ported unit run at relatively high speeds. Rotary vane or screw compressors could be typically selected for this application.

By way of example, for a 36,000 BTU/hr. heating capacity system, the first compressor means is sized to require three horse power at the air conditioning design point and could be boosted to demand about two horse power in the severe cooling mode when the first compressor demand is about one horse power. This fully loads the engine so that it can deliver the full heating load of the indoor space without adding an auxiliary burner or furnace. The difference between a gas engine heat pump and an electrically driven heat pump is severe because the recovery of engine waste heat changes the capacity balance point, dropping it to 10 to 15 degrees F. (−12° to −9.5° C.) for the engine driven heat pump. Consequently the boost level adequate for the gas driven heat pump would be quite inadequate for an electrically driven unit. This concept is clearly different and uniquely beneficial to the gas engine heat pump.

Although a preferred embodiment of the invention has been herein described, it will be understood that various changes and modifications in the illustrated described structure can be effected without departure from the basic principles that underlie the invention. Changes and modifications of this type are therefore deemed to be circumscribed by the spirit and scope of the invention defined by the appended claims or by a reasonable equivalence thereof.

I claim:

1. A refrigeration and/or heating system in connection with an internal combustion engine primary source of power and auxiliary source of reject heat, a cooling or heating load, and a heat sink or second source of heat to selectively provide heat to or remove heat from the load and including means for transferring exhaust and reject heat of the engine directly to the load, comprising:

a. a first compressor means to compress a refrigerant gas and means to convey the compressed refrigerant gas to;

b. a first heat exchanger means constructed to exchange heat between the heat sink or second source of heat in approximity thereto and the refrigerant therein, and a second heat exchanger means constructed to exchange heat between the load and the refrigerant therein, each heat exchanger means selectively connectable to the first compressor means to operate as either a condenser or an evaporator;

c. valve means in connection between the first and second heat exchanger means, selectively:

i) to cool the load by directing the refrigerant from the first compressor means through the first heat exchanger means to cool the refrigerant by heat exchange with the heat sink, and to direct the refrigerant from the first heat exchanger means to cool the load by heat exchange between the refrigerant and the load upon expansion of the refrigerant in the second heat exchanger means, or ii) to head the load by directing the refrigerant from the first compressor means through the second heat exchanger means to heat the load by exchange of heat from the refrigerant fluid to the load and to direct the refrigerant from the second heat exchanger means to the first heat exchanger means to heat the refrigerant by exchange of heat with the secondary heat source;

d. a second compressor means operatively connectable to a drive train from the engine and a clutch means selectively operable to engage or disengage the connection with the second compressor means;

e. a speed increaser means in the drive train between the clutch means and the second compressor means for increased speed, output, pressure, and capacity from the second compressor means when operating with the clutch means engaged;

f. valve means selectively operable to connect the input of the second compressor means to the output of the first heat exchanger means when the system is operating in a heating mode and the temperature of the second heat source is so low as to unload the first compressor means and require less engine speed and power, and thereby to precompress the refrigerant before return to the first compressor means with the second compressor means operating at a higher speed;

g. condition sensing means for determining the temperature of the second source of heat and to selectively connect the clutch means between the first compressor means and the speed increaser means and to selectively operate the valve means connecting the second heat exchanger means to the first heat exchanger means when the temperature of the second source of heat is below the requirements specified in f.) above; and so that when the clutch is engaged, the load on the engine is increased because of the higher speed of the second compressor, causing the engine to produce additional reject heat that is transferred to the load.

2. A system according to claim 1 wherein the condition sensing means is operable to engage the clutch and to connect the second compressor means between the first heat exchanger and the first compressor means when the temperature of the secondary source of heat is below about 35° F. (1.5° C.).

* * * * *